US007476798B1

(12) United States Patent
Beller et al.

(10) Patent No.: US 7,476,798 B1
(45) Date of Patent: Jan. 13, 2009

(54) COMBINED JACK AND COAXIAL BATTERY-ACCESS COVER FOR A STRINGED MUSICAL INSTRUMENT

(75) Inventors: Kevin Beller, Santa Barbara, CA (US); James A. Stryker, Santa Barbara, CA (US)

(73) Assignee: Carter Duncan Corp., Santa Barbara, CA (US)

( * ) Notice: Subject to any disclaimer, the term of this patent is extended or adjusted under 35 U.S.C. 154(b) by 0 days.

(21) Appl. No.: 11/825,830

(22) Filed: Jul. 10, 2007

(51) Int. Cl.
*G10H 1/32* (2006.01)

(52) U.S. Cl. ..... 84/743; 84/723

(58) Field of Classification Search ..... 84/723, 84/743

See application file for complete search history.

(56) References Cited

U.S. PATENT DOCUMENTS

| | | | | | |
|---|---|---|---|---|---|
| 3,662,223 | A * | 5/1972 | Marshall | 361/820 |
| 4,344,184 | A * | 8/1982 | Edwards | 455/95 |
| 4,519,287 | A * | 5/1985 | Naruse | 84/743 |
| 4,910,795 | A * | 3/1990 | McCowen et al. | 455/95 |
| 4,941,389 | A * | 7/1990 | Wendler | 84/727 |
| 4,995,293 | A * | 2/1991 | Anderson | 84/733 |
| 5,010,803 | A * | 4/1991 | Donnell | 84/743 |
| 5,018,204 | A * | 5/1991 | Christian | 381/74 |
| 5,025,704 | A * | 6/1991 | Davis | 84/723 |
| 5,424,725 | A | 6/1995 | Wandt et al. | |
| 5,585,767 | A * | 12/1996 | Wright, Jr. | 333/32 |
| 5,614,688 | A | 3/1997 | Donnell | |
| 5,689,082 | A * | 11/1997 | Youngblood | 84/743 |
| 5,693,898 | A | 12/1997 | Fishman | |
| 5,990,410 | A * | 11/1999 | Johnson | 84/731 |
| 6,242,682 | B1 | 8/2001 | Marinic et al. | |
| 6,271,456 | B1 * | 8/2001 | Nelson | 84/726 |
| 6,441,293 | B1 * | 8/2002 | LaBarbera | 84/723 |
| 6,653,543 | B2 * | 11/2003 | Kulas | 84/454 |
| 7,060,889 | B2 * | 6/2006 | Bellak | 84/741 |
| 7,247,789 | B2 * | 7/2007 | Fishman et al. | 84/723 |
| 7,351,905 | B2 * | 4/2008 | Ioffe | 84/723 |
| 2003/0094567 | A1 | 5/2003 | Ennes | |
| 2004/0074380 | A1 | 4/2004 | Fishman | |
| 2005/0045021 | A1 | 3/2005 | Berger et al. | |
| 2007/0003073 | A1 * | 1/2007 | Iriarte | 381/77 |

FOREIGN PATENT DOCUMENTS

GB 2393149 A * 3/2004

* cited by examiner

*Primary Examiner*—Walter Benson
*Assistant Examiner*—Robert W Horn
(74) *Attorney, Agent, or Firm*—J. E. McTaggart

(57) ABSTRACT

For battery-operated guitars and other stringed musical instruments, a coaxial battery-access cover cap mounts an audio phone jack that delivers the instrument's audio output. For battery access, the cover cap, which has a knurled rim for easy finger-gripping, can be removed from an attachment collar secured to the instrument with simple rotation of less than a half turn. As an option to enable the cap assembly to be installed in the instrument in place of an existing strap-peg, a strap-peg may be formed integrally on the cover cap around the jack opening. Extended embodiments can include an integral battery compartment with provision for mounting an electronic module enabling features including amplification, buffering, DSP and other effects in a self-contained system that requires only a single round opening for mounting in the instrument. The invention can be incorporated in original manufacture or as an after-market upgrade to practically any stringed instrument.

8 Claims, 3 Drawing Sheets

COMBINED JACK AND COAXIAL BATTERY-ACCESS COVER FOR A STRINGED MUSICAL INSTRUMENT

FIELD OF THE INVENTION

The present invention is in the field of musical instruments, and more particularly electric stringed instruments such as guitars, including those that may be originally equipped with electrical/electronic devices such as an on-board electric pickup, associated preamplifier, battery power supply, DSP (digital signal processing) and other sound processing effects.

BACKGROUND OF THE INVENTION

Apart from strictly acoustic instruments, it has become common practice to equip stringed instruments such as guitars with electronic sound reinforcement, typically, in an "electric" guitar, utilizing a magnetic pickup device that senses vibration of steel strings electro-magnetically, or in an "acoustic" instrument with non-metallic strings, utilizing a microphone pickup. The audio signal from the pickup is normally transmitted from the guitar to an external power amplifier/sound reinforcement system via a flexible audio cable fitted at each end with a connector plug, typically of the well known quarter-inch audio phone plug type, one end engaging a mating phone jack mounted in a suitable location on the instrument and the other end engaging a mating phone jack at the input of the external amplifier.

Many such instruments are in use without on-board amplification, with the pickup signal, usually modified by passive controls/components, fed directly at relatively high source impedance via the flexible audio cable. Such passive high impedance systems are inherently subject to environmental interference such as power line hum and to audio/musical performance degradation as a function of cable type, length, shielding integrity, characteristic impedance and termination impedance. As a technological refinement to mitigate such problems, with the advance of electronic technology there has been a trend to provide active on-board electronics: at least a pre-amplifier and buffer, typically powered from an on-board battery. The resultant lower source impedance and higher signal level make the system inherently far less vulnerable to degradation due to the above-mentioned audio cable variations, allowing much greater cable lengths and offering the player the potential of a wide variety of on-board control capabilities and special musical performance effects.

Guitars and other lute family instruments are typically supported for playing purposes by a shoulder strap attached to opposite ends of the guitar. At the body end, it is traditional to provide a central "strap-peg" or "end-pin" made of wood, plastic or metal, and configured with an annular flange to engage an opening, e.g. a slotted hole, in the shoulder strap end in a manner that is both secure for playing and readily removable.

DESCRIPTION OF KNOWN ART

Whether provided originally or added as after-market, an on-board battery generally requires modification of the basic original guitar body to provide a storage compartment for the battery, as well as an access opening needed for replacement, typically utilizing a hinged or removable cover. Particularly in high quality acoustic instruments such as guitars and violins, the extent of the modification required for battery access, even when enclosed with a metal or plastic plate, raises concerns regarding the degree of negative impact such modification will have on acoustic playing quality. It is typically problematic to decide where to locate the battery opening on the instrument for least potential detrimental impact.

U.S. patent publication 2004/0074380 to Fishman for a PACKAGED PREAMP discloses a packaged preamp with an integral pickup, a battery holder, an output jack, and a plurality of control mechanisms. A relatively large rectangular panel 12 is shown mounted to a side wall region 14 at the head end of an acoustic guitar 10, offset from the centrally-located strap-peg and is configured with an opening and cover for battery access.

U.S. Pat. No. 5,693,898 to Fishman for a HINGED CONTROL PANEL FOR ELECTRIFIED ACOUSTIC GUITAR shows a relatively large opening in a wall 1 of an acoustic guitar to accommodate assembly 2 having a fixed frame 10 hinged at 16 to panel 20 carrying a set of controls and output jack on its outer face and supporting, on the rear side, a circuit board 60, shield panel 70 and battery compartment 73.

U.S. patent publication 2005/0045021 to Berger et al for a STRAP BUTTON AND ATTACHMENT shows the strap button 11, i.e. "strap-peg", retained by screw 12 enclosed by a threadedly attached face cap 16 which is ornamentally shaped as a human face, optionally skeletal.

U.S. Pat. No. 5,809,136 to Turner for a CIRCUMFERENTIAL-CONTACT PHONE JACK SOCKET shows a jack socket with an entry opening 252 in an end cap that may optionally be shaped as a strap-peg 158 for an acoustic guitar.

OBJECTS OF THE INVENTION

It is a main object of the invention to enable original incorporation or after-market addition of active electronic apparatus into stringed musical instruments such guitars and the like, including an audio output jack along with convenient accessibility for replacement of on-board batteries, in a manner that requires minimal detrimental structural modification of the instrument and that imposes minimal impairment of the original inherent musical quality of the instrument, particularly if it is an acoustic instrument.

It is a further object to enable such incorporation and addition in a manner that requires only a single opening of relatively small size in a strategically located region of the body wall of the musical instrument.

BRIEF DESCRIPTION OF THE INVENTION

The foregoing objects and others have been met in the present invention which, in a basic embodiment for instruments that may be already equipped with active electronics, provides battery access via a coaxial cap assembly including a cover cap configured with a knurled rim for finger-gripping and a cylindrical rear cavity that fits over and engages a cap-attachment collar that is affixed to the host instrument in a manner that enables the cover cap to be readily removed by the user for battery access. Attached to the cover cap and extending to the rear is an audio phone jack that accepts a standard audio cable phone plug inserted though a central circular opening in the cover cap. The phone jack supports a battery contact spring that extends rearward into a battery compartment and makes contact with one of the battery cells. As an option to enable the cap assembly to be installed in the instrument in place of an existing strap-peg, a strap-peg may be formed integrally on the cover cap around the jack opening. The attachment collar may be internally threaded and mounted to the instrument via an externally threaded bushing that is dimensioned internally to serve as the battery access opening.

In an extended embodiment, this bushing may be made part of a main body of a battery compartment that is closed at the opposite end. In a further extended embodiment for introducing a first or additional electronic module into an instrument, the main body is adapted to support an electronic module physically and to connect it electrically to form a self-contained active electronic system that can receive input from the instrument's string pickup and deliver output at the phone jack. The entire assembly can mount in a single circular mounting hole through the instrument body wall, which becomes clamped between the collar at the open outer end and a hex nut tightened against the inner surface of the instrument wall. The invention can be incorporated in original manufacture or as an after-market upgrade to practically any stringed instrument.

BRIEF DESCRIPTION OF THE DRAWINGS

The above and further objects, features, and advantages of the present invention will be more fully understood from the following description taken with the accompanying drawings in which.

DETAILED DESCRIPTION

Figure 1:
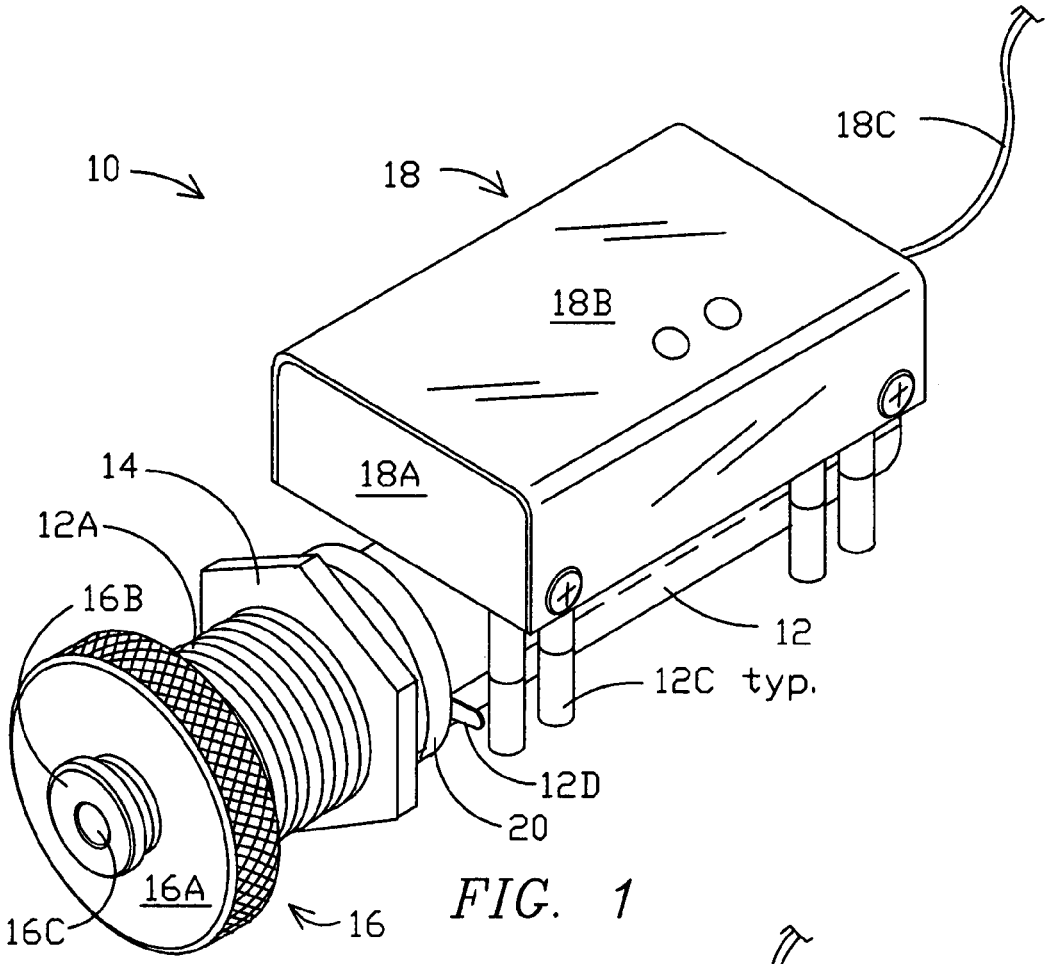
FIG. 1 is a perspective view of a preferred extended embodiment of the present invention shown in an assembled condition.

FIG. 1 depicts an assembled unit 10 of the present invention in an illustrative extended embodiment for incorporating active electronics into an instrument. The main body 12 is configured as a tubular sleeve of non-metallic material forming a cylindrically-shaped battery compartment that is closed at the rearward end, and that extends forwardly as a sleeve portion 12A that is externally threaded for mounting purposes and that is dimensioned internally to provide access at an open front end for battery installation and replacement.

The threaded sleeve portion 12A of main body 12 provides mounting for the entire unit 10, traversing a hole in the enclosure wall in the body of the instrument with a hex nut 14 bearing against the inside surface of the enclosure wall.

In cap assembly 16, a machined metal cover cap 16A with a knurled finger-grip rim may be further configured with a concentric strap peg 16B affixed at the front surrounding a central circular opening 16C of an audio phone jack that accepts a standard quarter-inch audio phone plug.

Inside a cylindrical cavity region configured in the rear of cover cap 16A, a cap-attachment collar (not visible in this view), threaded onto the end of the threaded portion 12A, serves the dual purpose of securing the unit 10 to the enclosure wall of the instrument body in co-operation with hex nut 14, and enabling convenient attachment/removal of cover cap 16A which engages the collar in a manner to be easily removed by the user for access to the battery compartment through the open front end of the threaded portion 12A of main body 12.

Mounted above main body 12 on pillars 12C, molded integrally with main body 12, is an electronics module 18 with a main chassis 18A and a cover 18B. Shielded wire 18C delivers the audio signal from the instrument pickup as input to module 18.

Behind hex nut 14 at the rearward end of the threaded portion 12A, a non-metallic annular terminal-retaining ring 20 surrounds and secures three electrical terminals, of which only terminal 12D is visible in this view.

Figure 2:
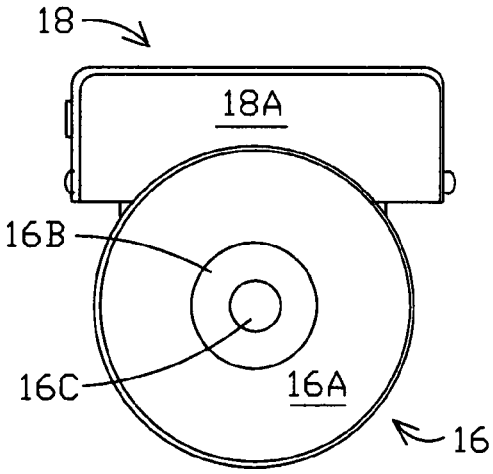
FIG. 2 is a front view of the subject matter of FIG. 1.

FIG. 2, a front view of unit 10 of FIG. 1, shows the front panel of module chassis 18A and the front view of cap assembly 16 with cover cap 16A, strap-peg 16B, and jack opening 16C.

Figure 3:
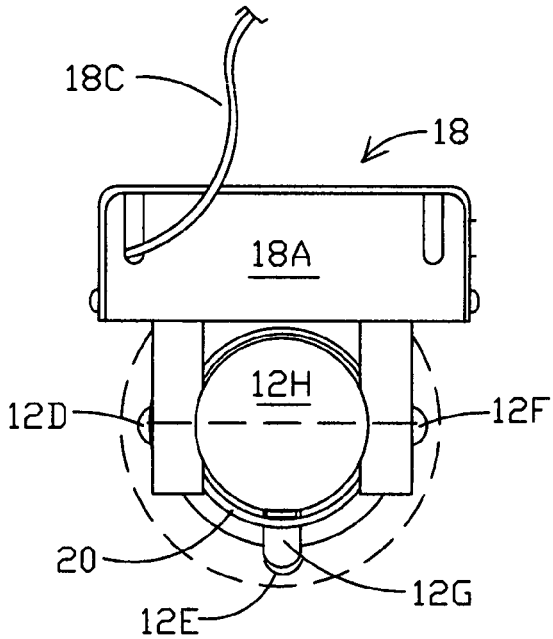
FIG. 3 is a rear view of the subject matter of FIG. 1.

FIG. 3, a rear view of unit 10 of FIG. 1, shows the rear panel of chassis 18A, the rear panel 12H of the tubular main body, a battery connection terminal 12G, a portion of jack connection terminals 12D, 12E and 12F surrounded and secured in place by ring 20, and the outline of the cover cap (16, FIG. 2) shown in broken lines.

Figure 4:
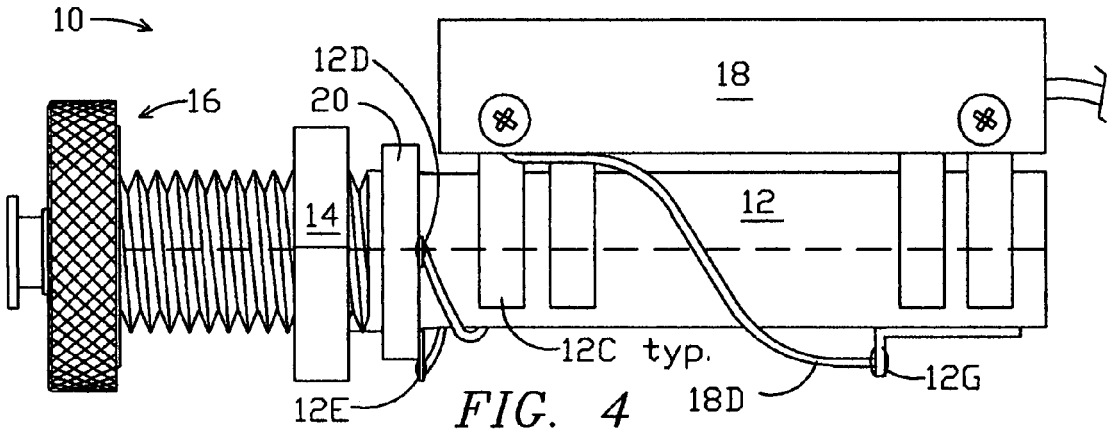
FIG. 4 is a side view of the subject matter of FIG. 1.

FIG. 4, a side view of unit 10, shows the electronics module 18, supported by the four pillars 12C. On the bottom side of main body 12, battery connector terminal 12G is shown with wire 18D connecting the (+) battery terminal to module 18. Terminals 12D and 12E are visible in this view, surrounded and secured in place by ring 20.

Figure 5:
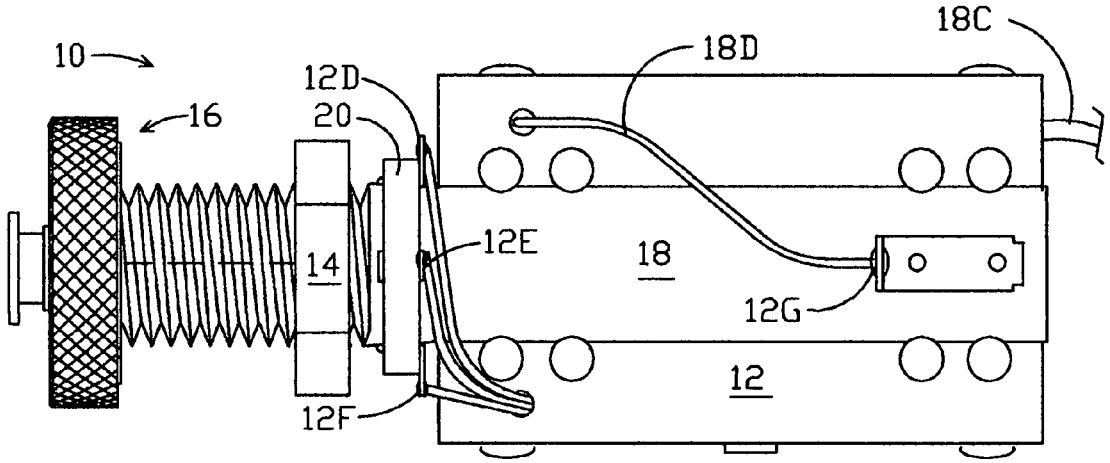
FIG. 5 depicts the subject matter of FIG. 4 rotated to show a bottom view.

FIG. 5 is bottom view of unit 10 rotated to show terminal 12G secured onto body 12, connecting wire 18D, the underside of electronics module 18 and terminals 12D, 12E and 12F, surrounded and secured in place by ring 20.

Figure 6:
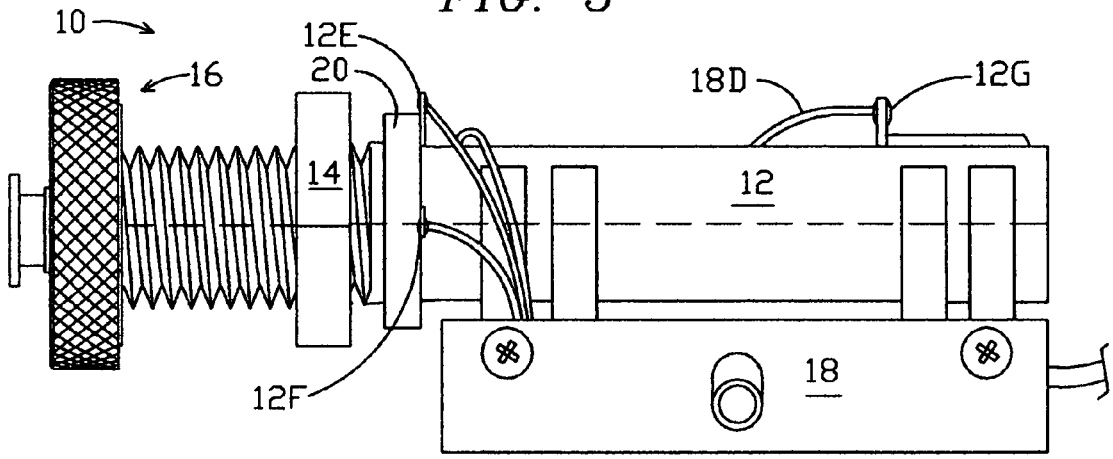
FIG. 6 depicts the subject matter of FIG. 5 further rotated to show an inverted view of the side opposite that shown in FIG. 4.

FIG. 6 depicts unit 10 having been further rotated to show an inverted side view of module 18 beneath main body 12 including battery terminal 12G and wire 18D. Jack terminals 12E and 12F are visible in this view, surrounded and secured by terminal-retaining ring 20, with hook-up wires leading into module 18.

Figure 7:
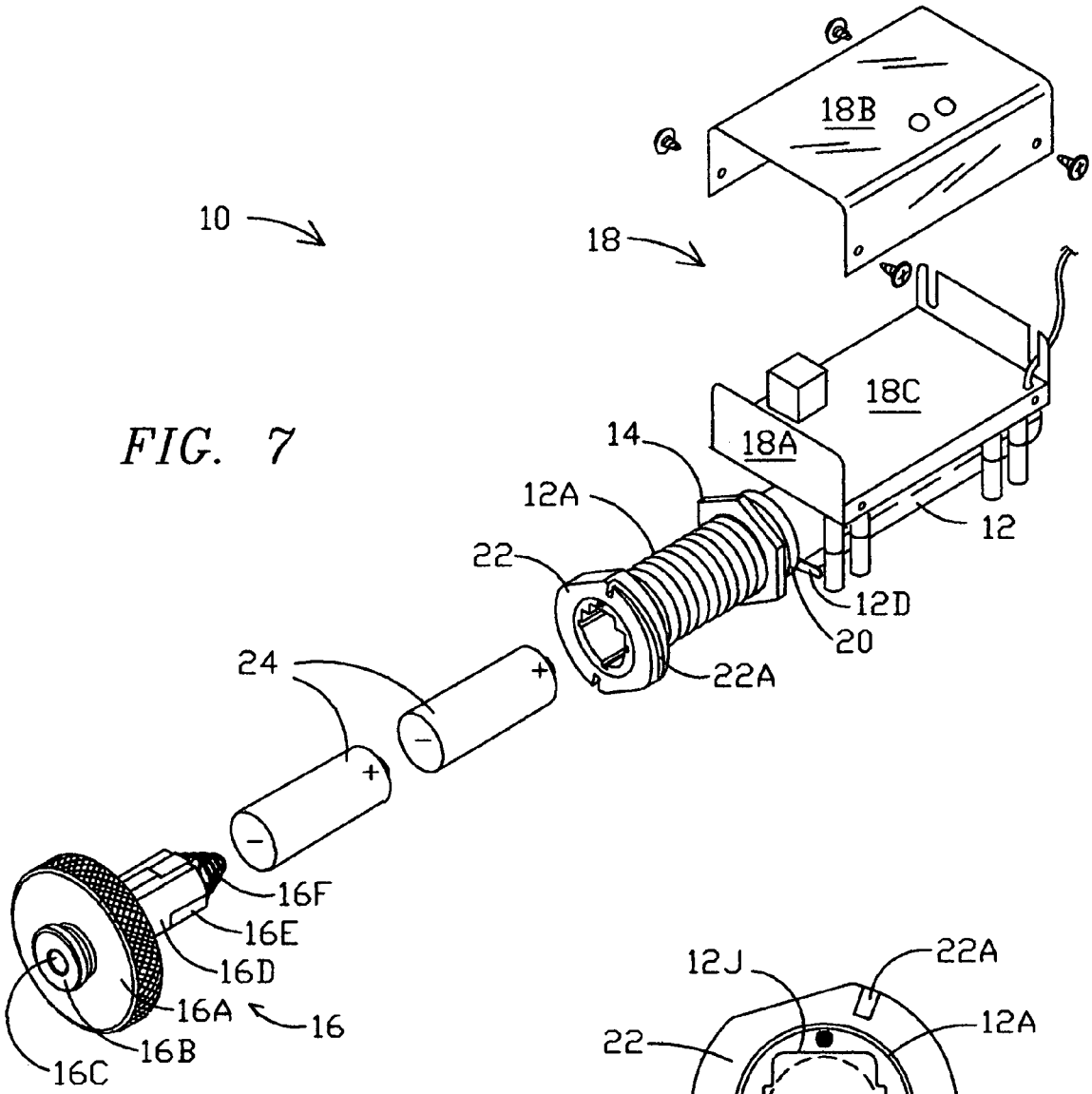
FIG. 7 is a three dimensional exploded view showing the subject matter of FIGS. 1-6 with the internal cover, cap assembly and batteries removed.

FIG. 7 is an exploded three-dimensional view of unit 10 showing module 18 with cover 18B removed and an electronic circuit board 18C in place. A pair of AA-sized battery cells 24 are shown having been removed from the battery compartment through the open end of the threaded portion 12A.

The cap assembly 16, with cover cap 16A, strap-peg 16B and jack opening 16C on the front side, includes the phone jack assembly in a plastic housing 16D which is mounted rotatably to cover cap 16A and extends to the rear as shown. Three internal contacts, one contacting the tip and two contacting the sleeve of an inserted mono audio phone plug, are extended through housing 16D to its outer surface where they constitute sliding contacts; of the three contacts only the exterior sliding portion of contact 16E is visible in this view.

When the cap assembly 16 is fastened in place in a working closed disposition by the user for normal playing of the instrument, the three contacts make electrical contact with a corresponding set of three contacts, inside threaded portion 12A of the main tubular body 12, which terminate at jack terminals 12D, 12E and 12F (refer to FIG. 5) located to the rear of threaded portion 12A, exemplified by the only one visible in this view: terminal 12D. A spiral spring 16F extends rearward from the cap assembly 16 to contact the (−) battery terminal. The two internal jack contacts that act on the sleeve portion complete the battery powering to the module 18 whenever there is a phone plug inserted into jack opening 16C, and thus the module 18 becomes automatically switched off whenever the phone plug is removed.

The cap-attachment collar 22, shown threaded onto the forward end of the threaded portion 12A of main body 12, is configured around its circumference with a pair of inclined channels 22A; these engage a pair of pins inside cover cap 16B to enable convenient attachment/removal of the cap assembly 16 with approximately a quarter turn of cover cap 16B.

When hex nut 14 is tightened against the rear side of the instrument body wall with collar 22 in place bearing against the front side, the unit 10 becomes firmly secured to the instrument via the threaded portion 12A of main body 12 extending through the enclosure wall of the instrument.

Figure 8:
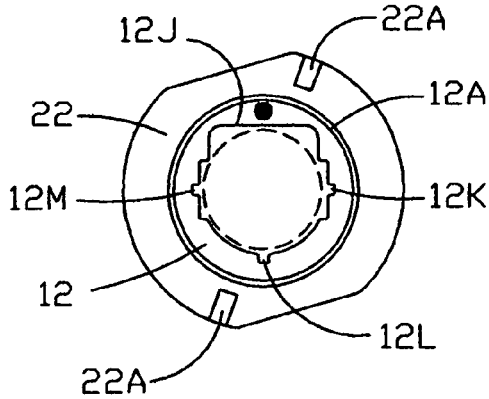
FIG. 8 is an enlarged front end view of the collar of FIG. 7.

FIG. 8 is a frontal view of the open end of sleeve 12 and collar 22 as they would appear on the musical instrument with cap assembly 16 removed. Collar 22 is configured with a diametrically-opposed pair of flat regions to facilitate tightening, e.g. with a spanner wrench. The central entrance to the battery compartment at the open end of main body 12 inside threaded portion 12A and the phone jack housing 16D are made to have a special shape, generally rectangular at the top, so as to provide keying that ensures proper orientation for alignment of the sliding contacts. For user convenience, distinctive color markings, e.g. white dots, are provided on the top side of the jack housing 16D and on the top region of the forward end of the threaded portion 12A of main body 12 to clearly indicate proper orientation for insertion when replacing the cap assembly 16. Three longitudinal channels 12K, 12L and 12M indicate the internal locations of sliding contacts associated with jack connection terminals 12D, 12E and 12F (FIG. 5) respectively, and correspond to small raised regions on the three mating sliding contacts associated with the phone jack, e.g. contact 16E on jack housing 16D (FIG. 7).

The plug portion, once inserted in place, is held non-rotatable relative to main body 12 by the entrance keying pattern (FIG. 8) to ensure proper sliding contact alignment; therefore the rear plug portion is attached to cover cap 16A in a freely rotatable manner to allow the quarter-turn rotation for attachment/removal of the cap assembly 16. Such rotatable attachment is accomplished by providing an integral hub, extending back from the center of the front panel of cover cap 16A, configured with an annular groove engaging four plastic fingers extending forward from the rear plug portion.

As an alternative to the illustrative embodiment described above which includes several optional elements that are not essential to basic practice of the invention, a basic embodiment for instruments already equipped with active electronics could include only the cap assembly 16 with the phone jack and associated audio/battery connection system extending into the inner wall of the battery access opening, and collar 22 attached to the instrument in a suitable manner, surrounding the battery access opening, utilizing a generic battery compartment.

The implementation of the battery compartment 12 as shown is not essential to the practice of the invention: a battery compartment with its single contact at the closed rear end could be provided in an alternative known implementation as a separate component initially independent of the cap assembly and its fastening collar. The threaded portion 12A could be provided separately as a threaded sleeve not directly attached to the main battery compartment 12.

While the embodiment as shown, with the strap-peg in location in place of an existing strap-peg, is believed to be beneficial to most guitars and other instruments in the lute group, the invention and/or the instrument itself could be practiced without a strap-peg. The location suggested as preferred for mounting an assembly according to the invention, i.e. in place of an existing strap-peg at a central end location of the instrument body, is not essential to the invention, which could be practiced with the assembly and/or the strap-peg located elsewhere on the instrument.

In an alternative to the one-piece main body/battery compartment shown in the illustrative embodiment, for manufacturing purposes, e.g. to facilitate molding, it may be beneficial to divide the main body shape at a central longitudinal plane into two generally mirror-image half parts to be assembled and fastened together in fabrication.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A combined audio jack and battery-access cover system, directed to musical instruments, particularly a host stringed musical instrument requiring an on-board battery power source for on-board electronic circuitry, comprising:

a cap assembly including (a) a cover cap, located external to the musical instrument, made and arranged to interface an exterior surface region of the instrument surrounding a battery-access opening and thus serve to cover the opening for normal use of the instrument, and (b) an audio phone jack including a jack housing attached inside the cover cap, made and arranged to make electrical contact with an audio cable phone plug inserted through a central jack opening configured in the cover cap; and cap-fastening/removal means made and arranged to enable a user to deploy said cap assembly in a working disposition wherein said cap assembly is held attached to the instrument with the battery-access opening covered for normal use of the instrument, and to enable the user to readily redeploy said cap assembly in a non-working disposition wherein the battery access opening is uncovered for purposes of battery replacement.

2. The combined audio jack and battery-access cover system as defined in claim 1 further comprising:

audio connection means for providing electrical interconnection between said audio phone jack and the electronic circuitry whenever said cap assembly is in the working disposition; and battery connection means for contacting terminals of a battery contained in the battery compartment so as to render the battery available as a power source for the electronic circuitry, whenever said cap assembly is in the working disposition retaining a contained battery.

3. The combined audio jack and battery-access cover system as defined in claim 1 further comprising:

an annular-shaped strap-peg, formed integrally with said cover cap, located coaxially in a central region thereof and configured with a central phone jack opening aligned with the phone jack opening of the cover cap, made and arranged to engage an end region of a known instrument support shoulder strap for instrument support and to allow functional insertion of a phone plug into said audio phone jack.

4. The combined audio jack and battery-access cover system as defined in claim 1 wherein said cap-fastening/removal means comprises:

an annular cap-attachment collar urged against an external surface of the instrument;

the cover cap being configured as a circular disk with a generally flat frontal surface and a circumferential flange extending to a rear edge thus forming a cylindrical inner cavity, the cavity and said collar being dimensioned to provide an easy sliding fit between an inner surface of the flange and an outer surface of said collar, with the rear edge of the flange interfacing the exterior region of the instrument;

said cover cap being configured with a pair of diametrically-opposed pins extending radially inwardly from the inner surface of the flange in regions thereof interfacing said collar;

said collar being configured in a circumferential region thereof with a pair of diametrically-opposed channels, each defining an inclined spiral path that terminates through a flat region of the forward side of said collar, such to enable said cover cap to be partially placed over said collar with the pins entered into and engaging the channels, then tightened into place against the surface of the instrument enclosure wall by rotation over a predetermined fraction of a turn, to thus enclose the battery compartment and thus deploy the working disposition of said cap assembly, and conversely by like rotation in an opposite direction, to enable said cap assembly to be removed from the instrument, thus deploying the non-working disposition so as to allow battery replacement.

5. The combined audio jack and battery-access cover system as defined in claim 4, further comprising:

a main body of generally tubular shape with a major portion constituting a battery compartment extending to a closed end fitted internally with a battery contactor, and a minor portion that is externally threaded and that extends to an open end dimensioned to serve as the battery access opening;

a hex nut threaded onto the externally threaded portion of said main body;

the threaded portion of said main body, including said hex nut threaded thereupon, being inserted from inside the instrument so as to traverse a circular opening in an enclosure wall of the instrument said cap-attachment collar being threaded onto the externally threaded portion of said main body and located at the open end thereof external to the instrument enclosure wall; and said hex nut being tightened to bear against an internal surface of the enclosure wall and thus co-operate with the said collar so as to secure said main body to the instrument by resultant compressive force acting on the enclosure wall.

6. The combined audio jack and battery-access cover system as defined in claim 2 wherein said audio connection means comprises:

a plurality of jack contact strip members in said audio phone jack, each configured internally with a corresponding contact strip having a first end made and arranged to contact a predetermined TRS (tip/ring/sleeve) portion of an inserted audio phone plug, and having a second and opposite end traversing an opening in the jack housing and made to terminate in a sliding contact portion located approximately flush with an exterior surface of the jack housing; and a corresponding plurality of transfer contact strip members installed in fabrication of said main body, each having a first end located flush with an interior surface of said main body within the threaded region thereof and extending past a threshold of an unthreaded region of said main body thence traversing a set of corresponding through-wall openings configured in said main body, to extend externally from said main body to a second end serving as a solder terminal for further wire connection to a corresponding connection point in the electronic module, whereby, when said cap assembly is placed into the working disposition, the jack housing enters the open end of said main body with its external contacts making contact with the corresponding contact members inside said main body, thus completing electrical connections between the plug and the on-board electronic module.

7. The combined audio jack and battery-access cover system as defined in claim 2 wherein the battery consists of a plurality of cylindrically-shaped battery cells disposed end-to-end and wherein said battery connection means comprises:

a first battery contact member mounted compliantly in a central region of the closed end of said main body and thus located around the central axis thereof, made and arranged to contact a first terminal of the battery, connected by a wire thus made available as "hot" battery supply line to the electronic module;

a second battery contact member formed as a spiral spring mounted on a rearward portion of the jack housing such that when said cap assembly is in the working disposition said second battery contact becomes located around the central axis and the spiral spring makes contact with a second terminal of the battery; and a battery connector strip having a first end connected to the spiral spring and a second end made available for appropriate connection to provide power to electronic circuitry.

8. The combined audio jack and battery-access cover system as defined in claim 7 wherein, to accomplish on/off switching of the electronic module automatically by insertion of the phone plug, an end of said battery connector strip is made and arranged to contact a sleeve portion of the inserted phone plug, the sleeve portion being connected to the common ground node of the electronic module via one of said jack contact strip members.

* * * * *